US007398620B1

(12) United States Patent
Jones

(10) Patent No.: US 7,398,620 B1
(45) Date of Patent: Jul. 15, 2008

(54) UNIVERSAL STRUCTURAL MEMBER SUPPORT AND POSITIONING SYSTEM

(76) Inventor: Terry V. Jones, 1804 Clay Ave., Terre Haute, IN (US) 47805

( * ) Notice: Subject to any disclaimer, the term of this patent is extended or adjusted under 35 U.S.C. 154(b) by 750 days.

(21) Appl. No.: 10/989,304

(22) Filed: Nov. 17, 2004

(51) Int. Cl.
*E04B 7/04* (2006.01)
*E04B 1/38* (2006.01)

(52) U.S. Cl. ..... 52/92.2; 52/712; 52/643; 52/93.2; 52/713

(58) Field of Classification Search ..... 52/92.1, 52/92.2, 93.2, 289, 702, 712, 643, 489.1, 52/696, 127.2, 93.1, 290, 241, 698, 690, 52/23, 713, 715, 664, 667, 665.1, 317; 248/300, 248/228.1, 231.9; 446/105, 116
See application file for complete search history.

(56) References Cited

U.S. PATENT DOCUMENTS

| | | | | | |
|---|---|---|---|---|---|
| 1,192,209 | A | * | 7/1916 | Kahn | 52/696 |
| 1,803,723 | A | | 5/1931 | Murphy | |
| 1,988,388 | A | | 1/1935 | Mioton | |
| 2,818,608 | A | * | 1/1958 | Lawrence | 52/292 |
| 2,902,951 | A | | 9/1959 | Maag | |
| 2,911,022 | A | | 11/1959 | Brown | |
| 2,964,807 | A | | 12/1960 | Kennedy | |
| 2,966,708 | A | | 1/1961 | Freeman, Jr. | |
| 3,289,362 | A | | 12/1966 | Whelan | |
| 3,292,481 | A | * | 12/1966 | Couch | 411/461 |
| 3,330,084 | A | * | 7/1967 | Russell | 52/300 |
| 3,360,892 | A | | 1/1968 | Rosso | |
| 3,390,494 | A | | 7/1968 | Chappie | |
| 3,421,270 | A | | 1/1969 | Chaney | |
| 3,438,169 | A | * | 4/1969 | Tinnerman | 52/712 |
| 3,672,112 | A | | 6/1972 | Sions et al. | |
| 3,845,601 | A | * | 11/1974 | Kostecky | 52/290 |
| 3,925,954 | A | | 12/1975 | Snow et al. | |
| 3,959,945 | A | | 6/1976 | Allen | |
| 3,967,908 | A | | 7/1976 | Snow et al. | |
| 4,080,771 | A | | 3/1978 | Weller | |
| 4,122,647 | A | | 10/1978 | Kovar | |
| 4,229,915 | A | | 10/1980 | Snow et al. | |
| 4,246,736 | A | | 1/1981 | Kovar et al. | |
| 4,361,999 | A | | 12/1982 | Sidney | |
| 4,410,294 | A | | 10/1983 | Gilb et al. | |

(Continued)

FOREIGN PATENT DOCUMENTS

| | | |
|---|---|---|
| DE | 3213358 A1 | 6/1983 |

(Continued)

*Primary Examiner*—Brian Glessner
*Assistant Examiner*—Jessie Fonseca
(74) *Attorney, Agent, or Firm*—Rosenberg, Klein & Lee

(57) ABSTRACT

A universal system (100) for support and positioning of building structural support members (20, 30) includes at least one longitudinally extended base plate (110) and at least one fixing member (120, 122). The base plate (110) has a plurality of slotted openings (116) formed therethrough. The fixing member (120, 122) has a pair of longitudinally spaced upstanding support members (1202, 1222) defining a structural member receiving space (118) therebetween. At least one of the upstanding support members (1202) is formed with a pair angularly extending flanges (132) that are elastically angularly displaceable to pass through a respective slotted opening (116) having corresponding portions (1164) at a different angle (C), and then return to their original angle (D) to prevent reversibly passing back through the slot (116).

20 Claims, 6 Drawing Sheets

U.S. PATENT DOCUMENTS

| | | | | |
|---|---|---|---|---|
| 4,490,956 | A | 1/1985 | Palacio et al. | |
| 4,596,101 | A | 6/1986 | Brinker | |
| 4,604,845 | A | 8/1986 | Brinker | |
| 4,637,195 | A | 1/1987 | Davis | |
| 4,669,235 | A | 6/1987 | Reinen | |
| 4,704,829 | A | 11/1987 | Baumker, Jr. | |
| 4,878,323 | A | 11/1989 | Nelson | |
| 4,965,980 | A | 10/1990 | Leavens | |
| 4,986,052 | A | 1/1991 | Nelson | |
| 5,236,273 | A | 8/1993 | Gilb | |
| 5,240,342 | A | 8/1993 | Kresa, Jr. | |
| 5,370,577 | A | 12/1994 | Jonett et al. | |
| 5,412,920 | A | 5/1995 | Hess | |
| 5,524,397 | A | 6/1996 | Byers et al. | |
| 5,551,200 | A | 9/1996 | Krug | |
| 5,596,859 | A | 1/1997 | Horton et al. | |
| 5,596,860 | A | 1/1997 | Hacker | |
| 5,606,837 | A | 3/1997 | Holizlander | |
| 5,857,306 | A | 1/1999 | Pellock | |
| 5,870,874 | A | 2/1999 | Brothers | |
| 5,884,448 | A | 3/1999 | Pellock | |
| 5,946,879 | A | 9/1999 | Pellock | |
| 6,170,218 | B1 | 1/2001 | Shahnazarian | |
| 6,174,119 | B1 | 1/2001 | Orr | |
| 6,219,975 | B1 | 4/2001 | Olden | |
| 6,295,781 | B1 | 10/2001 | Thompson | |
| 6,332,299 | B1 | 12/2001 | Stewart, III | |
| 6,401,423 | B1 | 6/2002 | Bergeron et al. | |
| 6,412,233 | B1 | 7/2002 | Jones | |
| 6,418,694 | B1 | 7/2002 | Daudet et al. | |
| 6,430,881 | B1 * | 8/2002 | Daudet et al. | 52/92.2 |
| 6,493,998 | B1 | 12/2002 | Pryor | |
| 6,672,014 | B1 | 1/2004 | Jones | |

FOREIGN PATENT DOCUMENTS

| | | |
|---|---|---|
| FR | 1477830 | 7/1967 |

* cited by examiner

UNIVERSAL STRUCTURAL MEMBER SUPPORT AND POSITIONING SYSTEM

BACKGROUND OF THE INVENTION

1. Field of the Invention

This invention directs itself to construction systems utilized for properly positioning building structural members that typically span between spaced walls, beams or columns. In particular, this invention directs itself to a system wherein at least one fixing member having a pair of upstanding support members is secured to a base plate by a self-locking arrangement. More in particular, at least one of the pair of upstanding support members is formed with a pair angularly extending flanges that are elastically angularly displaceable to pass through a slotted opening having corresponding angularly directed portions extending at a different angle, and then return to their original angle to prevent the support member from reversibly passing back through the slot. Still further, multiple base plates can be joined together using the self-locking feature of the fixing members to bridge between base plates. One upstanding support member of a fixing member is secured to each of two longitudinally adjacent base plates. Additionally, the base plates may be formed with a multiplicity of slotted openings, so that fixing members can be selectively assembled in any of a plurality of spacings corresponding different construction standards for the building structural members being supported.

2. Prior Art

Construction devices for positioning and securing structural members to supporting walls are well known in the art. The best prior art known to Applicant include U.S. Pat. Nos. 6,672,014; 6,412,233; 5,884,448; 5,606,837; 5,412,920; 4,878,323; 4,704,829; 4,669,235; 4,637,195; 4,596,101; 4,490,956; 4,361,999; 4,246,736; 4,122,647; 4,080,771; 3,959,945; 3,421,270; 3,390,494; 3,289,362; and, 2,964,807.

In earlier systems having an inventor in common with the inventor of the instant invention, as disclosed in U.S. Pat. Nos. 6,672,014 and 6,412,233, structural member receiving spaces are defined between vertically directed C-shaped channel members. The channel members are affixed to a base plate by a conventional means of fastening, such as welding. While the resulting mounting devices add considerable strength to the resulting building structure, their manufacture, packaging and storage are not highly efficient.

In some prior art systems, such as that disclosed by U.S. Pat. Nos. 4,080,771 and 4,669,235, there are provided truss aligning systems which become an integral part of the building structure when it is completed. In such systems, a flat metal member is provided which is mounted to the top plate of a building frame. The flat metal member has a plurality of pairs of upstanding flanges laterally spaced along the plate. Each of the pair of flanges are spaced apart one from another by a distance corresponding to the thickness of a roof truss or other structural member. Each of the flanges is provided with a plurality of apertures through which fasteners can be driven to secure the structural member thereto. However, the structures of such systems suffer from an inability to be inefficiently packaged for shipping and/or storage, and do not provide a significant amount of vertical rigidity and torsion resistance to building structural members. Further, such systems also require a multiplicity of different sized parts to be stocked to accommodate the different configurations common in the building industry.

SUMMARY OF THE INVENTION

A universal system for positioning and securing structural members to a building structure is provided that includes at least one longitudinally extended base plate. The base plate has a plurality of longitudinally spaced first slotted openings formed therethrough and extending in a direction substantially transverse with respect to the longitudinal direction. Each of the first slotted openings has a central laterally directed portion and a pair of opposing end portions extending angularly with respect to the central portion. Each of the end portions extends at a first predetermined angle. The system also includes at least one fixing member having a substantially U-shaped contour defined by a base section and a pair of upstanding support members extending from opposing longitudinally spaced ends of the base section to define a structural member receiving space therebetween. At least a first of the pair of support members has a central body and a pair of flanges extending angularly from laterally spaced sides of the central body. Each of the flanges extends at a second predetermined angle. The second predetermined angle is greater than the first predetermined angle. The flanges of the first support member are elastically angularly displaceable for passage of the first support member through a respective one of the first slotted openings in the base plate and for providing latching engagement with the base plate.

From another aspect, a universal system for positioning and securing structural members to a building structure is provided. The system includes a longitudinally extended first base plate having a plurality of longitudinally spaced first slotted openings formed therethrough and extending in a direction substantially transverse with respect to the longitudinal direction. Each of the first slotted openings has a central laterally directed portion and a pair of opposing end portions extending angularly with respect to the central portion. Each of the end portions extend at a first predetermined angle. The system includes a plurality of first fixing members. Each of the first fixing members has a substantially U-shaped contour defined by a first base section and a pair of upstanding first support members extending from opposing longitudinally spaced ends of the first base section to define a first structural member receiving space therebetween. Each of the pair of first support members has a central body and a pair of flanges extending angularly from laterally spaced sides of the central body. Each of the flanges extends at a second predetermined angle. The second predetermined angle is greater than the first predetermined angle. The flanges of each of the first support members are elastically angularly displaceable for passage of the pair of first support members through a respective pair of the first slotted openings in the first base plate and latching engagement with the first base plate. The system also includes at least one second fixing member having a substantially U-shaped contour defined by a second base section, a first upstanding support member and a second support member extending from opposing longitudinally spaced ends of the second base section to define a second structural member receiving space therebetween. The second support member has a first section extending in a first direction from the second base section and a second section extending from a distal end of the first section in a second opposing direction. The flanges of the first support member of the at least one second fixing member are elastically angularly displaceable for passage of the first support member of the at least one second fixing member through a respective endmost one of the first slotted openings in the first base plate and for providing latching engagement with the first base plate.

From yet another aspect, a method of forming a universal system for positioning and securing structural members is provided. The method includes the steps of providing at least one longitudinally extended base plate, and forming a plurality of longitudinally spaced slotted openings through the base plate that extend in a direction substantially transverse the longitudinal direction. Each of the slotted openings is formed with a central laterally directed portion and a pair of opposing end portions that extend angularly. Each of the end portions extend at a first predetermined angle. The method includes the step of providing at least one fixing member having a substantially U-shaped contour defined by a base section and a pair of upstanding support members extending from opposing longitudinally spaced ends of said base section. At least one of the pair of support members has a central body and a pair of flanges extending angularly from laterally spaced sides of the central body. Each of the flanges extends at a second predetermined angle, and the second predetermined angle is greater than the first predetermined angle. The method includes the steps of angularly displacing the flanges to extend at an angle coinciding with the first predetermined angle, and passing the at least one support member through a respective one of the slotted openings in the base plate. The method further includes the step of releasing the flanges to elastically return the angular extension thereof to the second predetermined angle for providing latching engagement with said base plate.

DESCRIPTION OF THE PREFERRED EMBODIMENTS

Figure 1:
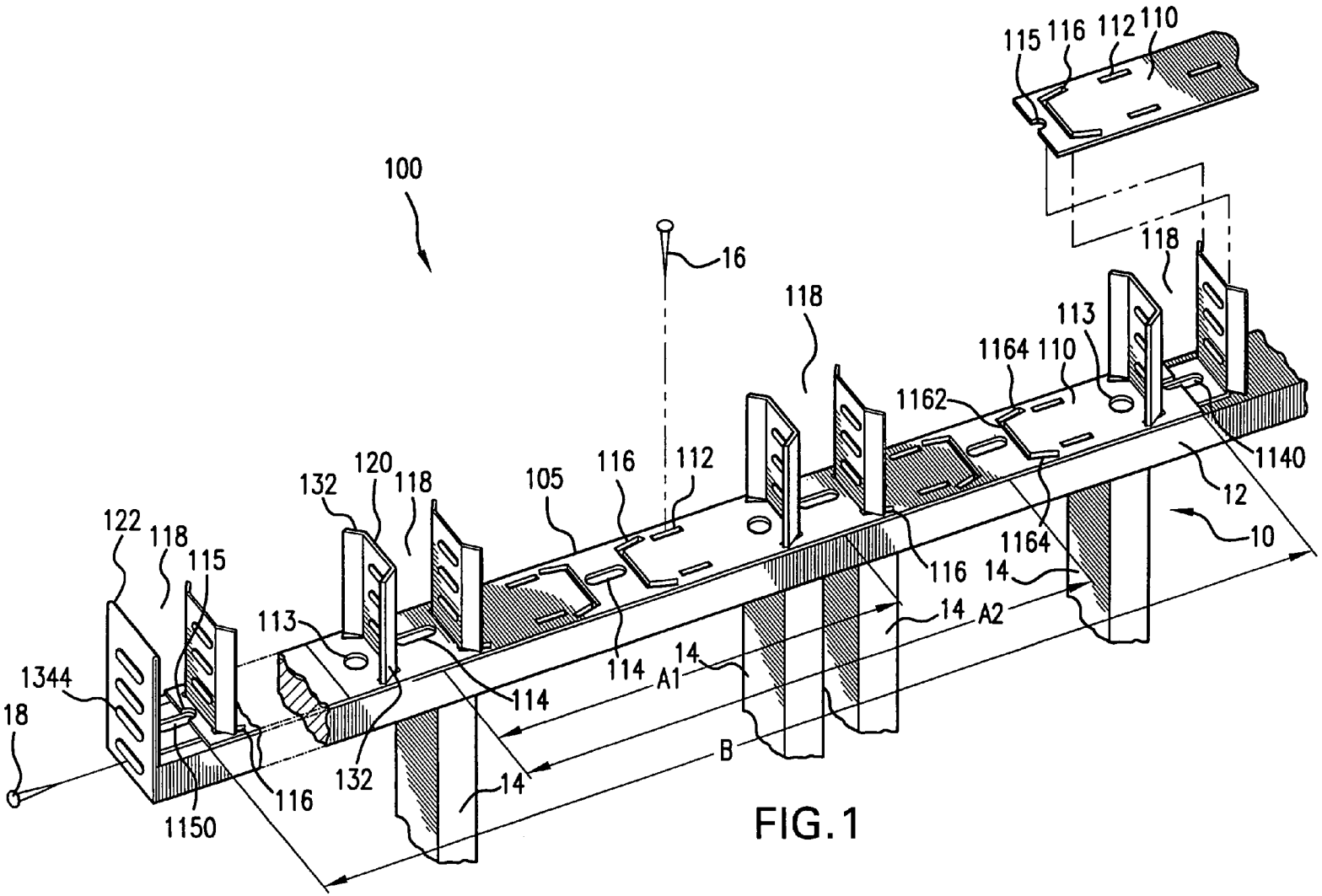
FIG. 1 is a perspective view of the present invention.

Referring now to FIGS. 1 through 6, there is shown structural member support and positioning system 100 for securing and properly locating structural members 20, 30 of a building during its construction. System 100 becomes a permanent part of a completed building, and facilitates the rapid setting of structural members such as roof trusses 20 or floor joists 30 between corresponding supporting structures, such as a pair of longitudinally extended laterally spaced building supporting walls 10 or steel beams supported by columns or walls, and provides improved strength of the resulting structure.

Referring more specifically to FIGS. 1, 2, 3, 4A and 4B, there is shown structural member support and positioning system 100 wherein at least one mounting device 105 is mounted to a supporting structure, such as the substantially horizontal surface portion of a longitudinally extended laterally spaced building supporting wall 10. Multiple mounting devices 105 can be easily serially joined one to another at the upper surface of a supporting structure, so that the base plate 110 of the mounting device 105 can be supplied in standard lengths that can be easily handled by users of system 100. It is contemplated that a substantially equal number of mounting devices 105 would likewise be mounted to another supporting structure across which the structural building members 20 span. In the example shown in FIG. 5, the structural building members are roof trusses having a lower truss member 22 and at least an upper truss member 24. In the example shown in FIG. 6, the structural building members are floor joists 30. Each of the mounting devices 105 has a plurality of structural member receiving spaces 118 formed thereon, so that the lower truss member 22 of each roof truss 20, or joist 30, can be positioned to extend between a pair of spaced supporting walls 10, for example.

As shown in FIG. 1, the mounting device 105 is secured to the header 12 that is supported by a plurality of studs 14 of a framed wall 10. The header 12 may be formed by one or more individual members, formed of wood, metal, laminated or composite materials, as permitted or required by local building codes, without departing from the spirit or scope of the inventive concepts disclosed herein. Each mounting device 105 is formed by a longitudinally extended base plate 110 having a plurality of openings formed therethrough. Openings 112 are formed in base plate 110 to provide a passage for fasteners 16 to secure the base plate 110 to the header 12, and although shown as slotted type openings, they may be formed by through holes of circular or other contours. Fasteners 16 may be screws, nails or bolts, as appropriate to the material of header 12 and local building codes. Openings 113 are provided for passage of bolts, such as those used in conjunction with steel beams, concrete or block walls. The openings 112 and 113 may be replaced with "knockouts" that are removable by the user to suit a particular installation.

Base plate 110 has a plurality of longitudinally spaced slotted openings 116 formed therethrough and extending across the base plate in a direction substantially transverse the longitudinal direction. Each opening 116 has a central laterally directed portion 1162 and a pair of angularly directed portions 1164 at opposing ends of the central portion 1162. The angularly directed slotted opening portions 1164 are each directed at a predetermined angle, an angle C (shown in FIG. 4), that may be within the approximate range of 98-134.5 degrees. As will be described in following paragraphs, the angle of each of the portions 1164 is at an angle that is approximately 0.5-2.0 degrees less than the angle of mating part that is passed therethrough.

Each mounting device 105 further includes a plurality of fixing members 120, 122 respectively secured to the base plate. Each fixing member 120 and 122 has a substantially U-shaped contour with a pair of upstanding support members 1202, 1202 and 1202, 1222 disposed in opposing spaced substantially parallel relationship defining a structural member receiving space 118 therebetween. At least one support member 1202 is formed by a central body 130 having a pair of vertically directed flanges 132 extending angularly from laterally spaced sides of the central body 130. Where a fixing member, such as fixing member 120, has two support members 1202, the flanges 132 of one support member 1202 extend in a direction that is a "mirror image" of the direction of the flanges 132 of the other support member 1202. Thus, the flanges 132 of each of the support members 1202 are directed away from the corresponding structural member receiving space 118.

The flanges 132 of support members 1202 are important to the structural integrity of the mounting device 105, and the functionality of structural member support and positioning system 100. The angularly directed flanges 132 that are part of each fixing member 120, 122 not only provides for an extremely rigid vertically directed structure to provide improved lateral stability and torsion resistance to the support of corresponding structural members 20, 30, but provides the means of securing the fixing member 120, 122 to the base plate 110. The angularly directed flanges 132 provide for what may be referred to as a "snap fit" or self-locking of the fixing members 120, 122 with the base plate 110 that allows for field assembly of the mounting device 105. Thus, a quantity of base plates 110 and fixing members 120, 122 can be separately packaged for shipment and/or storage. The ability to assemble mounting devices 105 at a construction site enables the user to configure the structural member support and positioning system 100 to suite the particular specifications for the building being constructed, and that avoids the necessity of stocking a variety of different configurations of mounting device 105.

In addition to the fixing member 120, the mounting device 105 may include one or more fixing members 122 respectively secured to the base plate 110 adjacent a longitudinal end thereof. Like the fixing members 120, fixing members 122 are formed by a support member 1202. The other upstanding support member 1222 is formed by an upwardly extending first section 1224 from which a downwardly directed second section 1226 extends. The second section 1226 is adapted to overlay and end portion of the header 12 of the framed wall 10 to provide for securement of the mounting device 105 thereto.

As can be seen in FIG. 1, each base plate 110 has an overall longitudinal dimension B which is selected to be a standard length suitable for the construction industry. The longitudinal dimension B of each mounting device 105 may be 8, 12 or 16 feet, for example. The center-to-center distance A1 between a first set of structural member receiving spaces 118 that are defined between respective pairs of slotted openings 116 is also selected to be a standard spacing utilized in the construction industry, such as 16 inches. While the center-to-center distance A2 between a second set of structural member receiving spaces 118 that are defined between a different combination of pairs of slotted openings 116 is selected to be another standard spacing, such as 24 inches. By that arrangement, the same parts, the fixing members 120 and base plates 110, can be assembled to form a mounting device 105 that could be used to support floor joists on 16 inch centers or roof trusses on 24 inch centers, for example. Obviously, the dimensions A1, A2 and B can be other than those mentioned above without departing from the inventive concepts disclosed herein. The universality of the system 100, allowing the base plate 110 and a selected combination of one or more of either or both of the fixing members 120 and 122 to be assembled in various different configurations, which improves the efficiency of the manufacture, distribution and use thereof. The height dimension of the upstanding support members 1202, 1222 of the fixing members 120, 122 is selected to be sufficient to provide stable support of structural members 20, 30. A height dimension approximating at least 25% of the height of the structural member being supported has been considered suitable in some prior art systems.

As is common in construction practice, building structural members such as roof trusses and floor joists are typically joined to supporting walls utilizing a fastening technique known as "toenailing." In toenailing, a fastener is driven angularly through a side of the structural member to exit a bottom surface thereof for securement into the upper member of a supporting wall. Mounting devices 105 support the use of the toenailing technique by the inclusion of a plurality of openings 114 formed through the base plate 110 in coincidence with each structural member receiving space 118, and by a through opening 115 formed in opposing longitudinal ends of the base plate 110. Each fixing member 120, 122 has a slotted through opening 1140, 1150 that is respectively aligned with the openings 114, 115 of base plate 110 when secured thereto. Thus, between each pair of upstanding support members 1202 or 1202 and 1222, of a mounting device 105, there is disposed an opening 114, 115 and 1140 or 115 and 1150 formed through the base plate 110 and respective fixing member 120, 122 through which a fastener exiting a bottom surface of a corresponding structural member can pass for entry into the header 12. Therefore, a fastener 26, shown in FIGS. 5 and 6, can be angularly passed through an opening 134, 1342 in a respective upstanding support member 1202, 1222 of a fixing member 120, 122 to secure the structural member 20, 30 to the header 12, and thereby secure the structural member 20, 30 to the mounting device 105.

Figure 2:
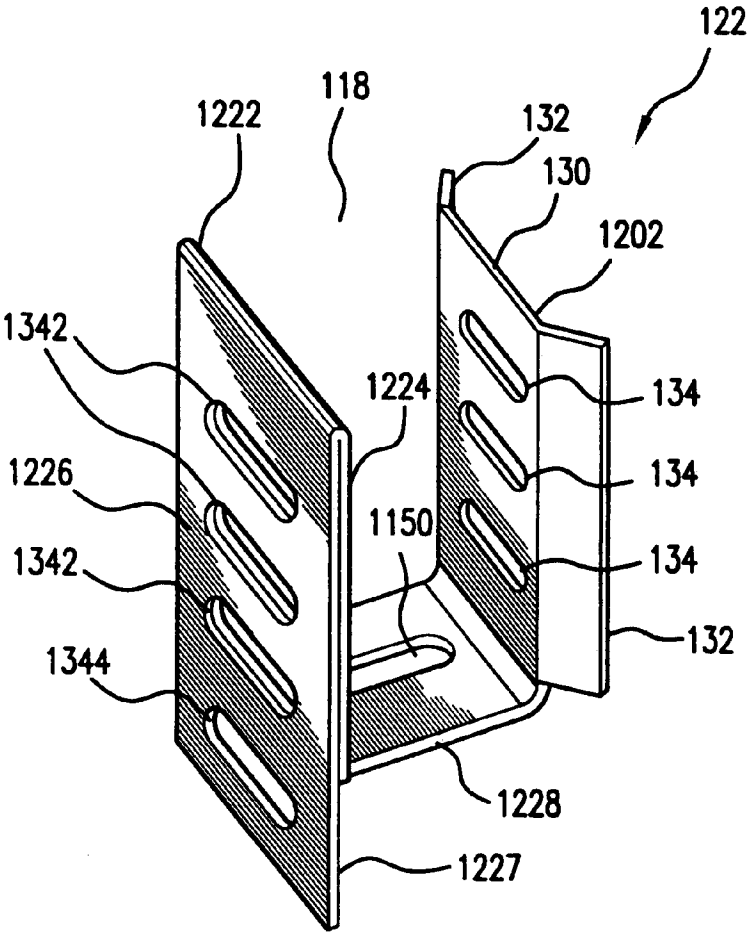
FIG. 2 is a perspective view of a fixing member of the present invention.

The fixing member 122 is shown in FIG. 2, and has a substantially U-shaped contour. Fixing member 122 has a base section 1228 with a longitudinally extended slotted through opening 1150 formed therein. An upstanding support member 1202 extends from one longitudinal end of the base section 1228, and another upstanding support member 1222 extends from the opposing longitudinal end of base section 1228, in substantially parallel relationship with support member 1202. Support member 1202 is formed with a central body 130 having a plurality of through openings 134 formed therein, and through which one or more fasteners can be selectively passed, utilizing "toenailing" or other fastening techniques. While openings 134 have been shown to be laterally extended slotted openings, they may alternately have any of a multiplicity of contours.

Support member 1202 includes a pair of flanges 132 respectively formed at the laterally spaced sides of the central body 130. Each of the flanges 132 extends from central body 130 at an angle D (for clarity shown in FIG. 3) that is within the approximate range of 100 degrees to 135 degrees with respect to the lateral extension of the central body 130. Of particular importance, is the fact that each of the of flanges 132 is elastically angularly displaceable to be reduce the angle D by an amount within the approximate range of 0.5 degrees to 2.0 degrees, to coincide with the angle C of the angularly directed portions 1164 of a corresponding opening 116. As will be further described in following paragraphs, the angular displacement of the flanges 132 of a support member 1202 permits that supporting member to be passed through a respective opening 116 and the subsequent elastic return of the flanges to their original angle D prevents the support member from passing back through the opening 116.

Support member 1222 is formed by a first section 1224 extending from the side of the base section 1228 and a second section 1226 extending from the distal end of first section 1224 in a direction opposite to that of first section 1224. Thus, in the most common orientation of mounting device 105, first section 1224 extends substantially vertically upwardly from base section 1228, and by virtue of an approximate 180 degree bend, second section 1226 extends substantially vertically downwardly. Second section 1226 has a distal portion 1227 that extends beyond the position of base section 1228 for being disposed in juxtaposition with an end of the header 12 and secured thereto. Like support member 1202, support member 1222 has a plurality of openings 1342 formed through both of the first and second sections 1224 and 1226, and through which one or more fasteners can be selectively passed, utilizing "toenailing" or other fastening techniques. While openings 1342 have been shown to be laterally extended slotted openings, they may alternately have any of a multiplicity of contours. The distal portion 1227 has a through opening 1344 formed therein for a fastener 18 to pass therethrough.

Figure 3:
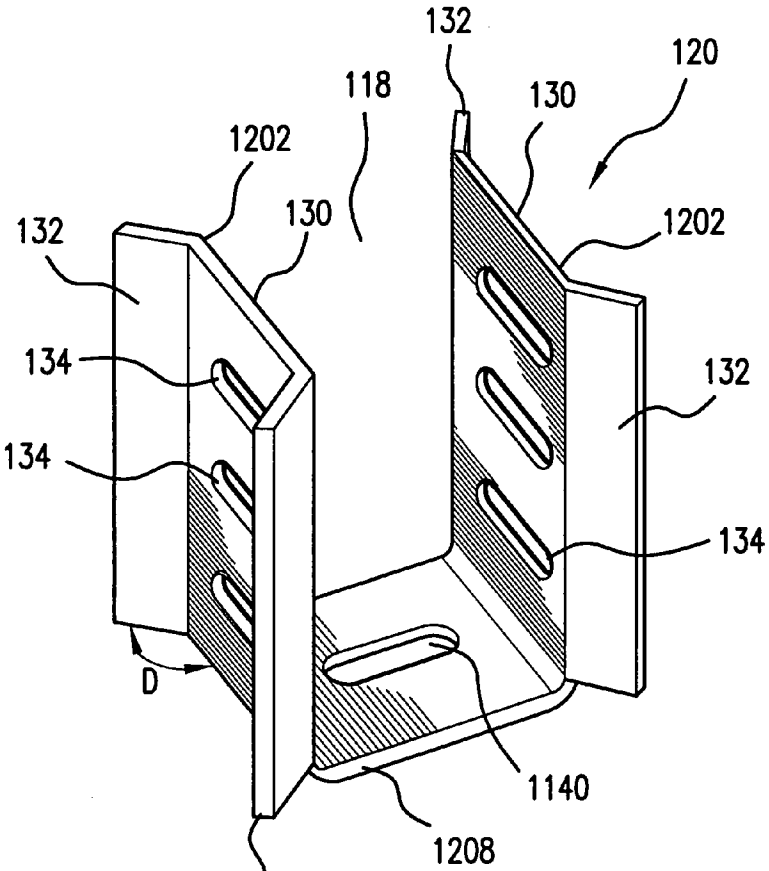
FIG. 3 is a perspective view of another fixing member of the present invention.

The fixing member 120 is shown in FIG. 3, and has a substantially U-shaped contour. Fixing member 120 has a base section 1208 with a longitudinally extended slotted through opening 1140 formed therein. A pair of upstanding support members 1202 respectively extend from the pair of longitudinal ends of the base section 1228, in substantially parallel relationship. Each support member 1202 is formed with a central body 130 having a plurality of through openings 134 formed therein.

As in fixing member 122, each support member 1202 includes a pair of flanges 132 respectively formed at the laterally spaced sides of the central body 130. Each of the flanges 132 extends from central body 130 at the angle D that is within the approximate range of 100 degrees to 135 degrees with respect to the lateral extension of the central body 130. Importantly, each of the of flanges 132 is elastically angularly displaceable to reduce the angle D by an amount within the approximate range of 0.5 degrees to 2.0 degrees, to coincide with the angle C of the angularly directed portions 1164 of a corresponding opening 116. The angularly directed flanges provide increased rigidity of the corresponding support member 1202 and thereby provide improved lateral stability and torsion resistance to the building structural member 20, 30 disposed in the corresponding receiving space 118.

Figure 4B:
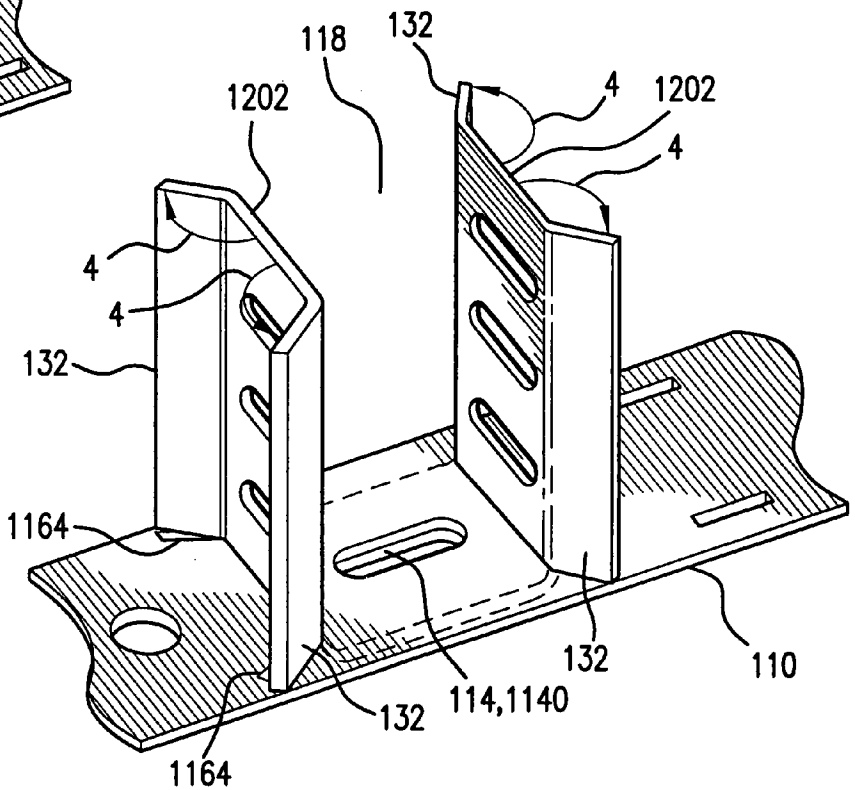
FIGS. 4A and 4B schematically illustrate the assembly of the fixing member of FIG. 3 to a base plate of the present invention.
Figure 4A:
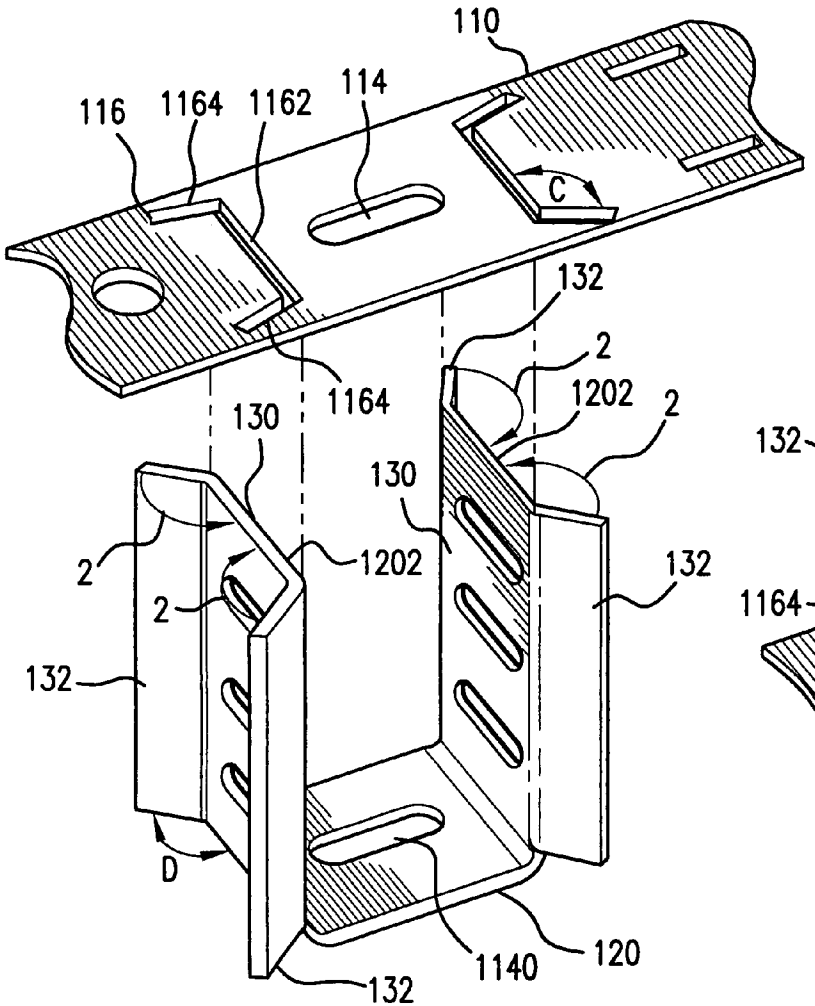
Figure 5:
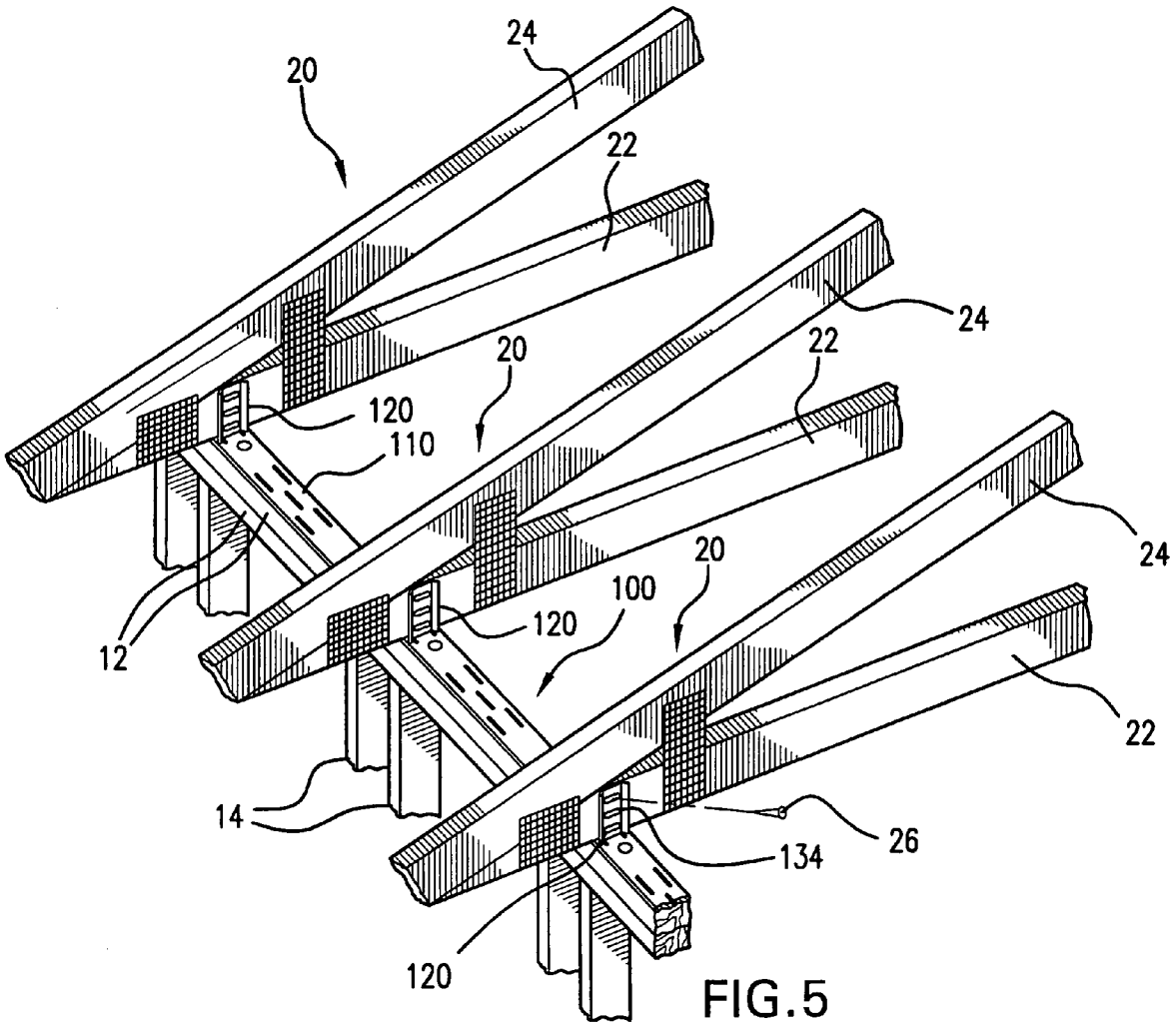
FIG. 5 is a perspective view illustrating an application of the present invention; and, FIG. 6 is a perspective view showing another application of the present invention.

Referring now to FIGS. 4A and 4B, the method of assembling a fixing member 120 to the base plate 110 is depicted. Base plates 110 and fixing members 120, 122 are supplied separately to a user for subsequent assembly and use in locating and securing roof trusses, floor joists, and other building structural members. To assemble a mounting device 105, the fixing members 120, 122 are secured to a base plate. The assembly of a fixing member to a base plate requires each of the upstanding support members 1202 to pass through a corresponding first slotted opening 116. While the overall shape of the first slotted openings 116 generally corresponds to the cross-sectional contour of the upstanding support members 1202, there is an intentional difference between the angle C of the angularly directed portions 1164 of the opening 116 and the larger angle D of the flanges 134. That difference is within the approximate range of 0.5 to 2.0 degrees. In order to pass a support member 1202 through a first slotted opening 116, the angle D of the flanges 132 thereof must be reduced to match the angle C of the angularly directed portions 1164 of a respective first slotted opening 116. Therefore, a user applies a force to the flanges 132 to angularly displace the flanges 132, as indicated by the directional arrows 2, sufficiently to pass each support member 1202 into a corresponding first slotted opening 116.

Once the flanges 132 of the support member(s) 1202 of a respective fixing member 120, 122 have passed through the first slotted opening 116, they elastically return to their original angular position, as indicated by directional arrows 4. Since the angle D of the flanges 132 has returned to their original value, the flanges 132 cannot pass back through the first slotted opening 116, and thereby lock the fixing member to the base member 110. With the fixing member secured in position, the openings 114 and 1140 are coaxially aligned so that a building structural member 20, 30 positioned in the corresponding receiving space 118 can be "toenailed" in place.

Figure 6:
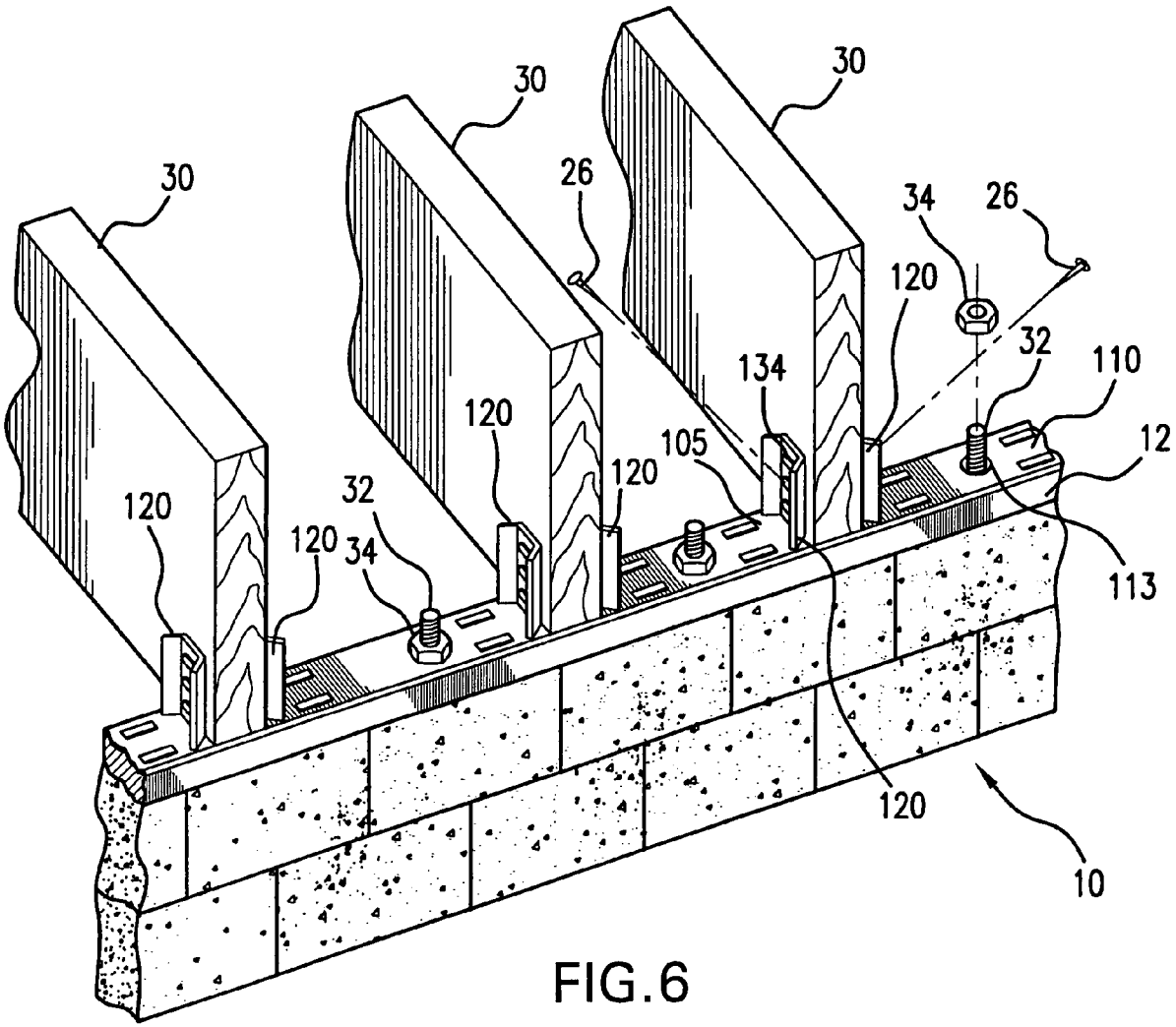

Referring now to FIG. 6, there is shown structural member support and positioning system 100 utilized for positioning and securing floor joists 30 to a supporting wall 10, which may be a foundation wall of a building. In this application, J-bolts 32 which have been set in the supporting wall 10 provide the means for securing the mounting device 105 thereto. The J-bolts 32 pass through corresponding through holes 113 wherein the threaded distal end thereof is engaged by a nut 34 which is tightened and holds the mounting device 105 in place. The floor joists 30 are positioned in the receiving spaces 118, between respective pairs of fixing members 120, and secured thereat by fasteners 26, in the same manner as when roof trusses are secured thereto.

Thus, it can be seen that system 100 provides a means for increasing the efficiency of building construction, providing a quick and easy method for accurately setting structural members, such as roof trusses and floor joists with proper spacing therebetween. System 100 further adds stability to the structure during the construction phase and increases the structural integrity of the completed building. A portion of the efficiency achieved by system 100 is a result of the use of angled flanges extending vertically on the lateral sides of the upstanding support member(s) 1202 of the fixing members 120 and 122. The support members 1202 are highly resistant to being deformed, as would otherwise result were the members formed by simple planar structures. The angularly elastically displaceable flanges 132 in combination with the angularly directed portions of the first slotted openings 116 being at different angles makes possible a self-locking type fit to secure the fixing members 120 and 122 to a base plate 110. That structure also facilitates the mounting devices 105 being arranged in a longitudinally consecutive manner, while still maintaining the proper spacing between structural members mounted therein.

The interlocking of successive base plates 110 is accomplished by locking one support member 1202 of a fixing member 120 into the last of the first slotted through openings of one base plate 110, and the other support member 1202 is locked into the first of the first slotted through openings 116 of another base plate 110, that fixing member 120 thereby bridging the two base plates 110. In that configuration, the opening 1140 of the bridging fixing member is aligned with the through openings 115 of the adjacent longitudinal ends of two base plates 110.

Although this invention has been described in connection with specific forms and embodiments thereof, it will be appreciated that various modifications other than those discussed above my be resorted to without departing from the spirit or scope of the invention, for example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A universal system for positioning and securing structural members to a building structure, comprising:

(a) at least one longitudinally extended base plate having a plurality of longitudinally spaced first slotted openings formed therethrough and extending in a direction substantially transverse said longitudinal direction, each of said first slotted openings having a central laterally directed portion and a pair of opposing end portions extending angularly with respect to said central portion, each of said end portions extending at a first predetermined angle; and, (b) at least one fixing member having a substantially U-shaped contour defined by a base section and a pair of upstanding support members extending from opposing longitudinally spaced ends of said base section to define a structural member receiving space therebetween, at least a first of said pair of support members having a central body and a pair of flanges extending angularly from laterally spaced sides of said central body, each of said flanges extending at a second predetermined angle, said second predetermined angle being greater than said first predetermined angle, said flanges of said first support member being elastically angularly displaceable for passage of said first support member through a respective one of said first slotted openings in said base plate and latching engagement with said base plate.

2. The system as recited in claim 1, wherein a second of said pair of support members of said at least one fixing member has a second central body and a pair of second flanges extending angularly from laterally spaced sides of said second central body, each of said second flanges extending at said second predetermined angle, said second flanges of said second support member being elastically angularly displaceable for passage of said second support member through a respective one of said first slotted openings in said base plate and latching engagement with said base plate.

3. The system as recited in claim 2, wherein said base plate has a plurality of longitudinally directed second slotted through openings formed in said base plate between respective pairs of said plurality of first slotted openings, and said base section of said at least one fixing member having a longitudinally directed third slotted opening formed therethrough and disposed in aligned relation with a corresponding one of said second slotted openings when said first and second support members are disposed in latching engagement with said base plate for passage of fasteners therethrough.

4. The system as recited in claim 2, wherein said base plate has a through opening formed in each longitudinal end of said base plate, and said base section of said at least one fixing member having a longitudinally directed slotted opening formed therethrough and disposed in aligned relation with said through opening in said end of said base plate when one of said pair of support members is latchingly engaged within an endmost one of said first slotted openings of said base plate for passage of fasteners therethrough.

5. The system as recited in claim 1, wherein a second of said pair of support members of said at least one fixing member is formed by a first section extending in a first direction from said base section and a second section extending from a distal end of said first section in a second opposing direction.

6. The system as recited in claim 5, wherein said second section of said second support member has a length dimension greater than a length dimension of said first section.

7. The system as recited in claim 5, wherein said base plate has a through opening formed in each longitudinal end of said base plate, and said base section of said at least one fixing member having a longitudinally directed slotted opening formed therethrough and disposed in aligned relation with said through opening in said end of said base plate when said first support member is latchingly engaged within an endmost one of said first slotted openings of said base plate for passage of fasteners therethrough.

8. The system as recited in claim 1, wherein said base plate has a through opening formed in each longitudinal end of said base plate, and said base section of said at least one fixing member having a longitudinally directed slotted opening formed therethrough and disposed in aligned relation with said through opening in said end of said base plate when said first support member is latchingly engaged within an endmost one of said first slotted openings of said base plate for passage of fasteners therethrough.

9. The system as recited in claim 1, wherein said second predetermined angle is with in the approximating range of 100-135 degrees and said first predetermined angle is approximately 0.5-2.0 degrees less than said second predetermined angle.

10. The system as recited in claim 1, wherein said plurality of first slotted openings include (a) a first set of pairs of said slotted openings, said pairs of said first set of slotted openings being longitudinally spaced from an adjacent pair of said first set of slotted openings by a first dimension, and (b) a second set of pairs of said slotted openings, said pairs of said second set of slotted openings being longitudinally spaced from an adjacent pair of said second set of slotted openings by a second dimension, said first dimension being a first standard building support spacing and said second dimension being a second standard building dimension greater than said first standard dimension.

11. A universal system for positioning and securing structural members to a building structure, comprising:

(a) a longitudinally extended first base plate having a plurality of longitudinally spaced first slotted openings formed therethrough and extending in a direction substantially transverse said longitudinal direction, each of said first slotted openings having a central laterally directed portion and a pair of opposing end portions extending angularly with respect to said central portion, each of said end portions extending at a first predetermined angle;

(b) a plurality of first fixing members, each of said first fixing members having a substantially U-shaped contour defined by a first base section and a pair of upstanding first support members extending from opposing longitudinally spaced ends of said first base section to define a first structural member receiving space therebetween, each of said pair of first support members having a central body and a pair of flanges extending angularly from laterally spaced sides of said central body, each of said flanges extending at a second predetermined angle, said second predetermined angle being greater than said first predetermined angle, said flanges of each said first support members being elastically angularly displaceable for passage of said pair of first support members through a respective pair of said first slotted openings in said first base plate and latching engagement with said first base plate; and, (c) at least one second fixing member having a substantially U-shaped contour defined by a second base section, a first upstanding support member and a second support member extending from opposing longitudinally spaced ends of said second base section to define a second structural member receiving space therebetween, said second support member having a first section extending in a first direction from said second base section and a second section extending from a distal end of said first section in a second opposing direction, said flanges of said first support member of said at least one second fixing member being elastically angularly displaceable for passage of said first support member of said at least one second fixing member through a respective endmost one of said first slotted openings in said first base plate and latching engagement with said first base plate.

12. The system as recited in claim 11, wherein said first base plate has a plurality of longitudinally directed second slotted through openings formed in said first base plate between respective pairs of said plurality of first slotted openings, and said first base section of each of said first fixing members having a longitudinally directed third slotted opening formed therethrough and disposed in aligned relation with a corresponding one of said second slotted openings when said pair of first support members are latchingly engaged with said first base plate through a corresponding pair of said first slotted openings for passage of fasteners therethrough.

13. The system as recited in claim 11, wherein said second section of said second support member has a length dimension greater than a length dimension of said first section.

14. The system as recited in claim 11, wherein said first base plate has a through opening formed in each longitudinal end of said first base plate, and said second base section of said at least one second fixing member having a longitudinally directed slotted opening formed therethrough and disposed in aligned relation with said through opening in a respective end of said first base plate when said first support member is latchingly engaged with said first base plate through an endmost one of said first slotted openings for passage of fasteners therethrough.

15. The system as recited in claim 11, wherein said first base plate has a through opening formed in each longitudinal end of said first base plate, and said first base section of each of said first fixing members having a longitudinally directed third slotted opening formed therethrough, said third slotted opening being disposed in aligned relation with a corresponding one of said through openings in a respective end of said first base plate when a respective one of said pair of first support members are latchingly engaged with said first base plate through an endmost one of said first slotted openings for passage of fasteners therethrough.

16. The system as recited in claim 11, wherein said second predetermined angle is with in the approximating range of 100-135 degrees and said first predetermined angle is approximately 0.5-2.0 degrees less than said second predetermined angle.

17. The system as recited in claim 11, further comprising a longitudinally extended second base plate having a longitudinal end joined to a respective longitudinal end of said first base plate.

18. The system as recited in claim 17, wherein said second base plate has a plurality of said first slotted openings longitudinally spaced thereon, and said first and second base plates being joined by said pair of first support members of one of said plurality of first fixing members being respectively latchingly engaged with said first and second base plates through an endmost one of said first slotted openings of each of said first and second base plates.

19. The system as recited in claim 11, wherein said plurality of first slotted openings include (a) a first set of pairs of said slotted openings, said pairs of said first set of slotted openings being longitudinally spaced from an adjacent pair of said first set of slotted openings by a first dimension, and (b) a second set of pairs of said slotted openings, said pairs of said second set of slotted openings being longitudinally spaced from an adjacent pair of said second set of slotted openings by a second dimension, said first dimension being a first standard building support spacing and said second dimension being a second standard building dimension greater than said first standard dimension.

20. A method of forming a universal system for positioning and securing structural members, comprising the steps of:

(a) providing at least one longitudinally extended base plate;

(b) forming a plurality of longitudinally spaced slotted openings extending in a direction substantially transverse said longitudinal direction through said base plate, each of said slotted openings being formed with a central laterally directed portion and a pair of opposing end portions extending angularly, each of said end portions extending at a first predetermined angle with respect to said central portion;

(c) providing at least one fixing member having a substantially U-shaped contour defined by a base section and a pair of upstanding support members extending from opposing longitudinally spaced ends of said base section, at least one of said pair of support members having a central body and a pair of flanges extending angularly from laterally spaced sides of said central body, each of said flanges extending at a second predetermined angle, said second predetermined angle being greater than said first predetermined angle;

(d) angularly displacing said flanges to extend at an angle coinciding with said first predetermined angle;

(e) passing said at least one support member through a respective one of said slotted openings in said base plate; and, (f) releasing said flanges to elastically return to an angle of extension at said second predetermined angle for providing latching engagement with said base plate.

* * * * *